US006018216A

United States Patent [19]

McIntosh

[11] Patent Number: 6,018,216

[45] Date of Patent: Jan. 25, 2000

[54] MULTIELEMENT SELECTIVE EMITTER

[76] Inventor: Devon R. McIntosh, 17609 Clinton Dr., Accokeek, Md. 20607

[21] Appl. No.: 08/924,496

[22] Filed: Aug. 27, 1997

[51] Int. Cl.[7] ..... H01K 1/04

[52] U.S. Cl. ..... 313/315; 313/578; 419/4

[58] Field of Search ..... 313/578, 580, 313/345, 315, 341, 112, 491; 419/4

[56] References Cited

U.S. PATENT DOCUMENTS

| | | | |
|---|---|---|---|
| 1,749,136 | 3/1930 | Heany | 313/341 |
| 3,973,155 | 8/1976 | Warren | 313/578 |
| 4,539,505 | 9/1985 | Riseberg | 313/315 |

OTHER PUBLICATIONS

D.L. Chubb, R.A. Lowe, "Thin–Film Selective Emitter" in J. of Appl. Phys. 74(9), pp. 5687–5698, Nov. 1, 1993.

*Primary Examiner*—Michael H. Day

[57] ABSTRACT

The invention, an incandescent light source, radiates a significantly larger portion of its power within the visible spectrum by enclosing an electrically heated tungsten filament, the radiant primary, within a cavity bounded by a two-layer refractory oxide composite, the radiant secondary. The scattering and absorption coefficients of both layers are manipulated such that the inner layer is substantially absorbing in both the visible and the IR, while the outer layer, though optically thick across the spectrum, is substantially absorbing (and therefore substantially emissive) in the visible while being highly reflective in the IR High temperature cavity radiation established by the radiant primary is absorbed by the inner layer of the secondary, thereby heating both layers such that they radiate brilliantly. The outward emissions of the inner layer are absorbed or reflected back by the outer layer, while the emissions of the outer layer are externally radiated at substantially higher luminous efficiency than that of a tungsten filament.

7 Claims, 2 Drawing Sheets

MULTIELEMENT SELECTIVE EMITTER

BACKGROUND

1. Field of Invention

This invention pertains to improving the percentage of radiation emitted at visible frequencies from an incandescent emitter, and particularly to providing an incandescent light bulb which significantly improves upon the 7% efficiency currently available from state of the art incandescent light bulbs.

2. Theory

A body which absorbs and emits electromagnetic (E-M) energy is comprised of systems of charged particles which absorb and emit photons and which can, for illustrative purposes, be arranged into groups of many systems with each group forming a volume element Since the systems comprising each volume element mutually interact (primarily via the photon field at incandescent temperatures), thermal equilibrium can be established, at which point there will be an equilibrium distribution of absorption and emission processes and an equilibrium distribution of photons. In addition, to maintain this steady state, the absorption and emission rates (which indicate the degree of interaction among systems) must be equal, and since the energy and particle distributions of an interacting system which is in thermal equilibrium is independent of the degree of interaction, the equilibrium photon distribution is the same function for all materials regardless of the extent of interactions. Plank found the equilibrium photon energy density distribution within volume elements of index of refraction $n_r$ to be equal to $(n_r)^3 w(v,T)/c$ where, $$w(v, T)=8\pi h v^3 c^{-2}(e^{hv/kT}-1)^{-1} \tag{1}$$

Here, h is Plank's constant and k is Boltzman's constant. Therefore, by multiplying the energy density by $(c/n_r)a_v$, the rate at which radiation of frequency v is being absorbed, the E-M energy per unit time per unit frequency per unit volume absorbed at frequency v in material of absorption coefficient $a_v$ is, $a_v(n_r)^2 w(v,T)$. And as stated above, to maintain detailed balance in thermal equilibrium, this must also be the E-M power generation rate.

Consider radiation generated in a horizontal layer, of unit area and of thickness dx, situated a distance x below the surface of a parallel-sided slab of material of thickness X. The radiant power per unit frequency from this layer which reaches the underside of the upper surface at near normal incidence in the solid angle dω is $a_v n_r^2 w(v,T)e^{-a_v x}dxd\omega/4\pi$. Integrating over dx from 0 to X gives the total primary radiation reaching the underside of the surface, and allowing for reflections at the surfaces, the radiant power per unit frequency exiting the surface into the external solid angle dΩ is $\epsilon_v(w(v,T)/4\pi)d\Omega$ where $\epsilon_v$ is (1−R)(1−T)/(1RT), and where R is the reflectivity and T, being equal to $\exp(-a_v X)$, is the transmissivity of the slab. For a highly absorbing slab (i.e. an optically thick slab where $a_v X>>1$), $\epsilon_v$ reduces to 1−R while for a highly transmissive slab (i.e. an optically thin slab where $a_v X<<1$), $\epsilon_v$ reduces to $a_v X$. A totally absorbing slab (i.e. $\epsilon_v$ equals 1 at all frequencies) is called a black body and w(v,T)/4π is the normal (perpendicular) radiant power density emission per unit frequency of such a body. Allowing for the cosine dependence of non-normal emerging radiation, the radiant power emitted per unit area per unit frequency over all angles in the emergent hemisphere is w(v,T)/4. Correspondingly, the radiant power emitted per unit area per unit wavelength is $M_{e,\lambda}(T)$, where λ is the wavelength, and is plotted in FIG. 1 as a function of λ for several values of T. The other curve in the graph, V(λ), is a plot of the relative variation of eye sensitivity with wavelength. Note that the greatest increases, w.r.t. temperature, in the percentage of visible light radiated occur below 2400 K.

In general $\epsilon_v$ can vary from 0 to 1 and is called the spectral emissivity. A body with $\epsilon_v$ constant but less than 1 is called a gray body, and a body with significantly increased emissions (over that of a gray body emitter of the same total power) within a selected spectral bandwidth is called a selective emitter. It is important to note that the derivation of $\epsilon_v$ assumes optical scattering only at the boundary surfaces and is one of the reasons why, for non-scattering media, the only way to obtain a selective emitter is to have a thin body with $a_v>>1/X$ in the spectral region of interest (i.e. at visible frequencies) only, or a thick body with R small in the spectral region of interest. However, the costs and technical problems associated with fabricating macroscopic refractory bodies with negligible internal optical scattering renders these types of selective emitters impractical. Moreover, the physical support needed for a large surface thin body, coupled with its IR transparency means the substrate generated IR is externally transmitted, thereby negating the thin body selectivity. And the relatively small variations in R exhibited by most refractories within the visible and near IR regions is not enough to effect an efficient thick body selective emitter.

For inhomogeneous media with scattering throughout the body, the calculation of $\epsilon_v$ is much more involved because the necessary radiant energy transfer relationships are in terms of the integro-differential equation, $$\frac{d i_v(x,\omega)}{dx} = -a_v i_v(x,\omega) + a_v i_{vb} - \sigma_v i_v(x,\omega) + \frac{\sigma_v}{4\pi}\int_{4\pi} i_v(x,\omega_i)\Phi(\omega,\omega_i)\,d\omega_i \tag{2}$$

$i_v(x,\omega)$ is the intensity at x in the direction ω, $a_v$ is the absorption coefficient at v, $i_{vb}$ is the black body radiant power density at v at the local temperature, $\sigma_v$ is the scattering coefficient, and ϕ is the scattering function that tells how much of the intensity in direction $\omega_i$ is scattered into direction ω. Chub and Lowe (1993) solved this equation for a mono-temperature slab of thickness d, index of refraction $n_f$, and surface reflectivity $\rho_{v0}$, which is uniformly imbedded with isotropically scattering optical inhomogeneities, and which is mounted on a substrate of surface reflectivity $\rho_{vs}$(w.r.t. the slab) and emissivity $\epsilon_{vs}$ (w.r.t. the slab) to obtain the emissivity (where $\epsilon_v$ is equivalently defined as the intensity integrated over all angles within the emergent hemisphere divided by that of a black body at the same temperature) as a function of optical thickness, scattering and absorption.

$$\varepsilon_V = \frac{1-\rho_{V0}}{DEN}\left\{\begin{array}{c}\varepsilon_{vs}[L_1(1)L_2(\mu_M)-L_1(\mu_M)L_2(1)]+\\ l_3(1)\{L_2(\mu_M)+\rho_{vs}[(L_2(\mu_M)-\rho_{v0}L_1(\mu_M))\times\\ (L_1(1)-l_2(1))-L_1(\mu_M))]-l_3(\mu_M)DEN\end{array}\right\} \tag{3}$$

Definitions of the various functions are given in Appendix A. A plot of $\epsilon_v$ as a function of $z_v$ for asymptotically large values of $K_{vd}$ (i.e. $K_{vd}>>1$), where $z_v=\sigma_v/(a_v+\sigma_v)$ and $K_{vd}=(a_v+\sigma_v)d$, is shown in FIG. 2. The constants used for the slab and substrate, $n_f=2$, $\rho_{v0}=0.15$, $\epsilon_{vs}=1$, $\rho_{vs}=0$, reflect the optical characteristics of the emitter. It is clear from the figure that, with scattering, highly discriminating selective emitters can be had for optically thick media with $\epsilon_\nu$ large in the spectral region of interest.

DESCRIPTION OF PRIOR ART

In a typical light bulb, electrical energy heats a wire filament (almost exclusively made of tungsten) to a temperature of around 2800 C causing it to incandesce. The problem is that approximately 75% of the supplied energy is radiated in the infrared (IR) outside the visible spectrum. Another 18% is wasted as heat conducted through the glass encasement and base of the bulb making incandescent lighting only about 7% efficient (as opposed to fluorescent lighting which is around 22% efficient). In addition, incandescent bulbs are relatively short-lived (their average lifetime is 750–1000 hours as opposed to around 8000 hours for fluorescent bulbs) because, at such high temperatures their filaments loose mass over time via evaporation and eventually break. The greater the filament diameter the longer the bulb life. But since, for the same input power, higher temperatures require smaller diameters, yet a greater fraction of the input power is radiated in the visible spectrum at higher temperatures, a tradeoff between filament diameter and bulb efficiency results, leading to a compromise between bulb life and bulb efficiency. Compared to fluorescent lighting, the typical incandescent light bulb is a short-lived inefficient source of light. But the fact that it is still one of the most popular source of lighting around the world testifies to the importance of its versatility and low cost resulting from its compact size, simple design and independence from any additional external operating circuitry. And although improvements meant to bridge the gap have come from both sides (for instance halogen incandescent bulbs have fractionally improved efficiencies and a longer life, and compact electronic fluorescent lighting gives improved versatility), none have come close to combining the versatility and low bulb cost of basic incandescent lighting with the long life and efficiency of fluorescent lighting.

One straightforward way of increasing incandescent lighting efficiency is simply to concentrate most of the energy within the direction most needed via the use of reflecting surfaces, but currently only specialized lighting applications such as photography, spotlighting, floodlighting and film projection make use of such directional incandescent bulbs for three main reasons. The first is that the total efficiency of such lamps is significantly less than that those without reflectors due to losses upon reflection. For instance, the output efficiency of a typical 100 W floodlight is approximately 65% that of a typical nonreflecting 100 W lamp. The second reason is that such bulbs cost substantially more and the increased cost does not justify their use solely on the basis of their energy saving potential. The third reason is that in many general lighting situations it is preferable to have some light emitted in all directions, albeit more intensely in some directions than in others, however no current directional lighting designs allow for that possibility.

Another way of increasing incandescent lighting efficiency is to burn the filament at higher temperatures. However, as mentioned above, the filament would have to be thicker to prevent premature burnout, and a thicker filament requires significantly more power to heat it. Therefore, to date, only the larger wattage bulbs (300 to 500 watts) have been operated at these slightly elevated temperatures. For instance, a typical 500 watt bulb is 1.2 times as efficient as a typical 100 W bulb.

A third way of increasing incandescent lighting efficiency is the standard selective emitter approach mentioned earlier. (Actually tungsten is a selective emitter of sorts because there is almost a two fold increase in its emissivity at visible frequencies compared to that within the near IR, but with such a relatively mild change it is still generally categorized as a gray body emitter, albeit a gray body with a different 'color' temperature than thermodynamic temperature). Certain refractory oxides such as magnesia, alumina, thoria, chromia, ceria, and zirconia have long been recognized to posses varying degrees of selective emissivity. However since these oxides are comparatively brittle and nonconducting or poorly conducting, many indirect means have been proposed to exploit their high frequency selectivity. (See for example, Heany—U.S. Pat. No. 1,749,136—Mar. 4, 1930, Warren—U.S. Pat. No. 3,973,155—Sep. 3, 1976, and Riseberg—U.S. Pat. No. 4,539,505—Sep. 3, 1985). However heretofore none have been successful, and although there are a variety of reasons for this, they all share two fundamental flaws.

(1) They rely mainly on thermal conduction between an electrically heated metal (or metal composite) filament to heat the refractory oxide to incandescence. This arrangement is a problem because above about 2000 K, the metal-to-oxide surface to surface contact required for thermal conduction promote corrosion and phase instabilities at the boundaries. And since the portion of visible light emitted at temperatures below 2200 K is very small (FIG. 1), the efficiencies of selective emitters operated below this temperature are correspondingly small.

(2) Since the commercial oxides used are multicrystalline, optical scattering media, their emissivities are given by Eq. (3), but no prior selective emitter designs have utilized a similar equation to quantitatively determine the importance of the relative and absolute magnitudes of the scattering and absorption coefficients, or how to best adjust them to enhance the emissivity.

OBJECTS AND ADVANTAGES

A primary objective of the invention is to provide a selective emitter which, when mounted in a light bulb in place of the usual tungsten filament, constitutes a source of light which combines:

(1) the versatility and low cost inherent in state of the art incandescent lighting, (2) efficiency which meets or exceeds that of fluorescent lighting, (3) lifetimes which exceed that of state of the art incandescent lighting.

A secondary objective of the intention is to provide a directional selective emitter which is more efficient and lasts longer than current directional incandescent bulbs without costing more.

DRAWING FIGURES

DESCRIPTION OF THE INVENTION

Figure 2:
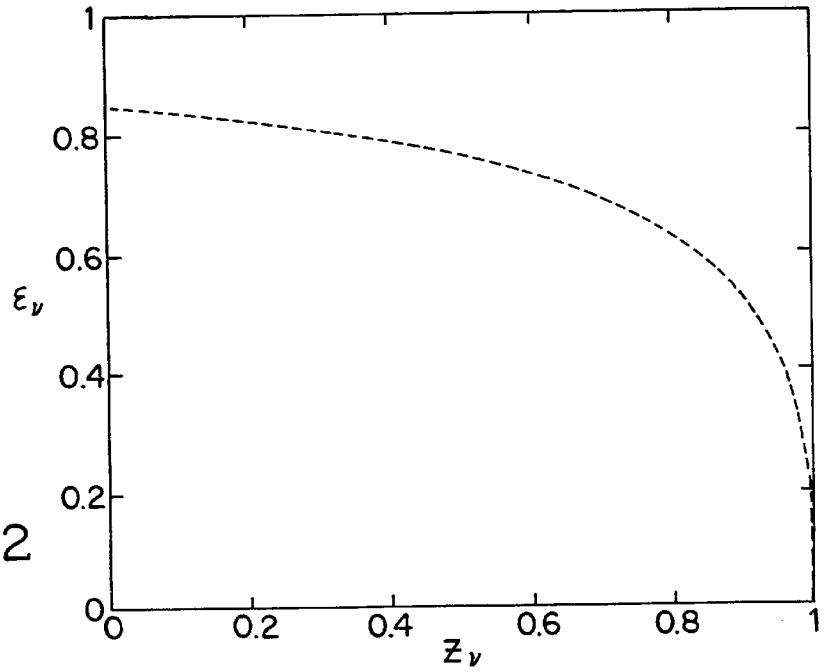
FIG. 2 is a plot of emissivity as a function of $z_\nu$ for an optically thick scattering medium.
Figure 3:
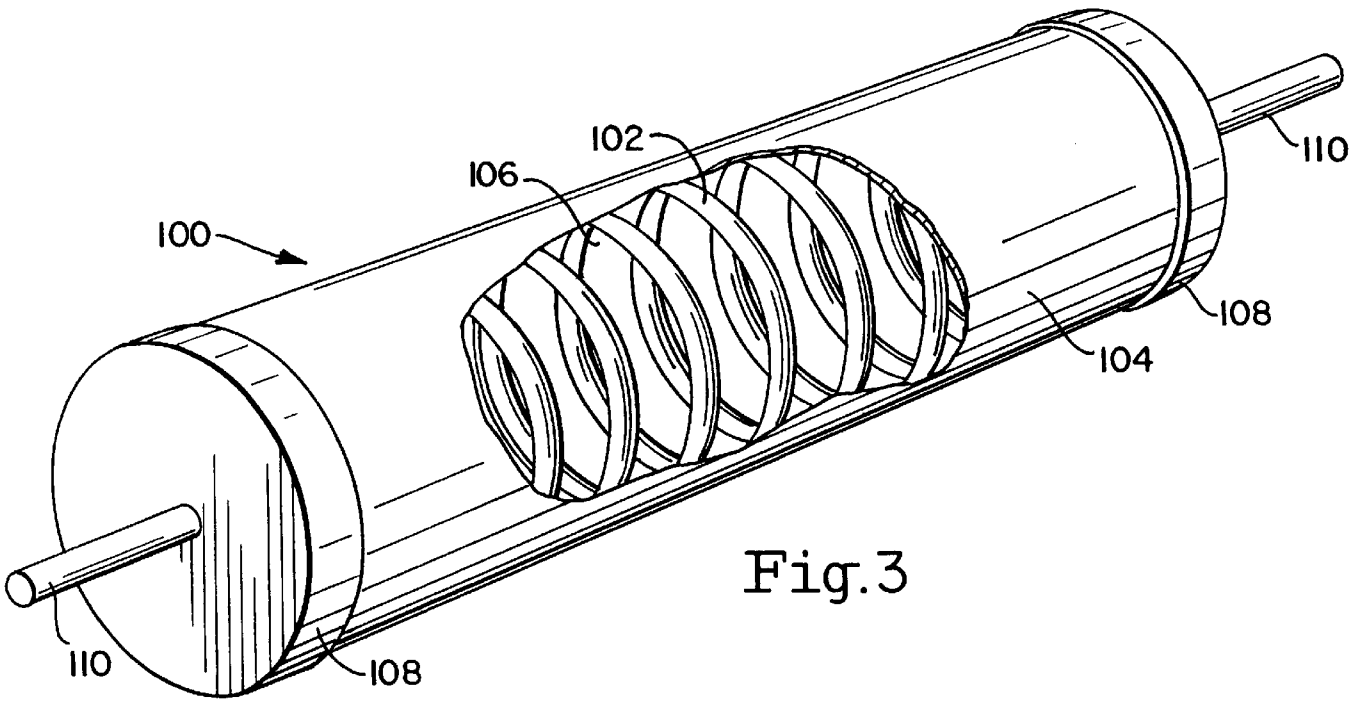
FIG. 3 is a perspective view of a typical embodiment of the invention showing the filament w ire., used as the radiant primary, mounted within the hollow, high luminous efficiency, refractory oxide radiant secondary which encloses the radiant cavity and which efficiently converts the energy radiated from the radiant primary to light.
Figure 4:
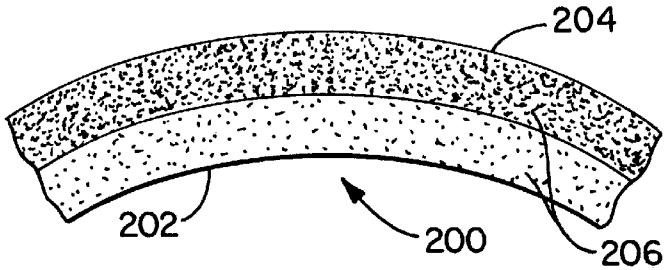
FIG. 4 is a closer look at the wall of the radiant secondary showing the outer reflecting layer which externally emits and the inner absorbing layer which powers the outer layer.

FIGS. 2 to 4

The invention is a selective emitter which exploits three important properties of optically scattering media (see Eq. (3) and FIG. 2) not found in nonscattering media.

(1) Scattering media allow an additional degree of freedom exercised through $z_\nu$ by which essentially the same material can be made to have Aide ranging values of emissivities. Therefore, in the invention, $\epsilon_\nu$ is manipulated by manipulating $z_\nu$ via $a_\nu$ and $\sigma_\nu$.

(2) An optically thick ($K_{\nu d}$>>1) slab can exhibit selective emissivity based on its spectral absorption coefficient, $a_\nu$. This is because the scattering limits the distance below the surface from which significant amounts of internally generated radiation can reach the surface, thereby causing an optically thick slab to appear thin as far as emergent radiation is concerned and making the invention a beneficiary of the advantages inherent in a thick selective emitter. For instance, in addition to being easier to handle and more durable, the thick selective emitting component of the invention can be made to have a total (surface and volume) near IR reflectivity which is very close to one even though its surface reflectivity is not.

(3) For two absorption coefficients, $a_{\nu 1}$ inside spectral band 1, and $a_{\nu 2}$ inside spectral band 2, having a particular fixed coefficient ratio $a_{\nu 1}/a_{\nu 2}$ (for specificity say $a_{\nu 1}$ is larger than $a_{\nu 2}$), and associated emissivities $\xi_{\nu 1}$ and $\xi_{\nu 2}$, for thick slabs, the larger the $z_\nu$ (or equivalently for a smaller $1-z_\nu=a_\nu/(a_\nu+\sigma_\nu)$), the larger the emissivity ratio, $\epsilon_{\nu 1}/\epsilon_{\nu 2}$. For example, for, $a_{\nu 1}/a_{\nu 2}=100$ and $1-z_{\nu 1}=1$ (i.e. no scattering), $\epsilon_{\nu 1}/\epsilon_{\nu 1}=1$ while for, $a_{\nu 1}/a_{\nu 2}=100$ and $1-z_{\nu 1}=0.1$ (~10 times more scattering than absorption), $\epsilon_{\nu 1}/\epsilon_{\nu 2}=6.3$. This attribute is clearly seen in the graph of FIG. 2 where $\epsilon_\nu$ decreases rapidly for $1-z_\nu<<1$. Therefore, in the invention, $\sigma_\nu$ is made much larger than $a_\nu$ so that $1-z_\nu$ can be much less than 1 and radiant emissions can be limited to the visible region as much as possible.

FIG. 3 shows a typical embodiment of the invention with a wall cut-out drawn in for illustrative purposes. In normal operation, the emitter is sealed inside an evacuated glass bulb similar to a typical incandescent light bulb. The selective emitter 100 is comprised of a tightly coiled tungsten filament wire 102 (drawn loosely for illustration) mounted inside a hollow ceria ($CeO_2$) doped, 5% calcia (CaO) stabilized zirconia ($ZrO_2$) ceramic cylinder 104, enclosing a cylindrical radiant cavity 106 and capped by two zirconia end caps 108 (throughout, stabilized zirconia will just be referred to as zirconia). In the multielement design of the invention the filament wire is referred to as the radiant primary while the ceramic cylinder is the radiant secondary. Two tungsten connection tips 110, run through each end cap and, in this embodiment, are the only components in physical contact with the filament wire. (Two embodiments mentioned at the end of the next section allow for the possibility of physical contact between primary and secondary). They provide electrical contact between the power source and the filament wire as well as the physical points of support for holding up the entire emitter 100 within the glass bulb (not shown). To electrically insulate the connection tips from the end caps (zirconia conducts somewhat at elevated temperatures), a nonconducting, high temperature adhesive is used to fasten the former through a sufficiently large hole in the latter.

As indicated in FIG. 4, the wall of the radiant secondary 200 is comprised of two concentric layers each roughly 0.3 mm thick, 5 mm in diameter and 30 mm long. The interior layer 202 is comprised of submicron grain size zirconia doped with approximately 20 volume percent ceria. The mixture is ballmilled then isostatically pressed to form a tightly compacted powder, after which submicron grain size zirconia doped with about 1 volume percent ceria is injected concentrically around this inner compact and is lightly compacted to form the outer layer 204. The two layer preform is then sintered at around 900 C. The goal is to get, after firing, an inner layer of roughly 3% porosity with scattering coefficient $\sigma_\nu=\sigma=200$/cm, and an outer layer of roughly 20% porosity with scattering coefficient $\sigma_\nu=\sigma=10^4$/cm. Primarily, scattering occurs at the optical discontinuities resulting from the voids 206 in the porous structure. The scattering coefficients can be approximated to be the same in the near IR as in the visible because the void dimensions are generally significantly larger than the wavelengths of interest within the visible and the near IR, and within this entire spectral range, the index of refraction outside the voids is significantly different than that within the voids.

The particular combination of zirconia and ceria is used for the following reasons.

(1) Ceria has absorption coefficients in the visible band which are orders of magnitude higher than those in the IR (a necessary characteristic of the emitting component in a selective emitter), while the absorption coefficients of zirconia are orders of magnitude smaller than those of ceria (a necessary characteristic of the host matrix used in the composite design of the invention).

(2) Zirconia and ceria are refractory materials with high melting points even for refractories (greater than 2900 K), and show appreciable vaporization within a vacuum only when within 300 K of this temperature (the emitter is operated within a vacuum).

(3) Zirconia, $ZrO_2$, and ceria, $CeO_2$, have the same cubic crystal structure with the same second element, oxygen, so that at high temperatures, even if some atomic substitution between the cerium and zirconium atoms occurs, the composition and structure of the composite does not change. Although not as ideal, there are other composites which could be used in similar composite designs. These include ceria doped thoria, chromia doped alumina, chromia doped magnesia, and chromia doped calcia.

The absorption coefficient of ceria can be approximated by the Urbach's rule equation, $$a_\nu=a_0\exp[-b_0(E_0-h\nu)/kT], \tag{4}$$

where $E_0=3.78$ eV, $a_0=7.6\times10^7$/cm, and $b_0=0.90$ from measurements taken at 291<T<1235 K. For lack of higher temperature data, these constants are assumed to hold up to the 2325 K operating temperature of the invention. Noting that at the stated volume fractions, the actual absorption coefficients of the composite are those of ceria multiplied by its volume fraction, two illustrative absorption coefficients pertaining to the inner layer at 2400 K are, $a_\nu=15200$/cm in the middle of the visible region ($\lambda=0.55$ $\mu$m) and $a_\nu=26$/cm in the near IR at $\lambda=1.5$ $\mu$m. (The visible region extends from 0.4 $\mu$m to 0.76 $\mu$m). Due to the decreased volume fraction of ceria, the corresponding coefficients pertaining to the outer layer are $a_\nu=760$/cm and $a_\nu=1.3$/cm respectively. It can therefore be seen that although the inner and outer layers are comprised of the same materials (albeit with different porosities), their optical characteristics characterized by $1-z_\nu=a_\nu/(a_\nu+\sigma_\nu)$ are significantly different. $1-z_\nu$ is much larger for the inner layer than for the outer layer, and from the variation of emissivities with $1-z_\nu$ as shown in FIG. 2, it is clear that this results in an inner layer which is significantly more absorbing than the outer layer and an outer layer which is significantly more reflective than the inner layer. (For any material, absorbtivity is equal to emissivity, and since both these layers are optically thick, meaning transmissivity is essentially zero, whatever impinging radiation is not absorbed is reflected).

Theory of Operation

Figure 1:
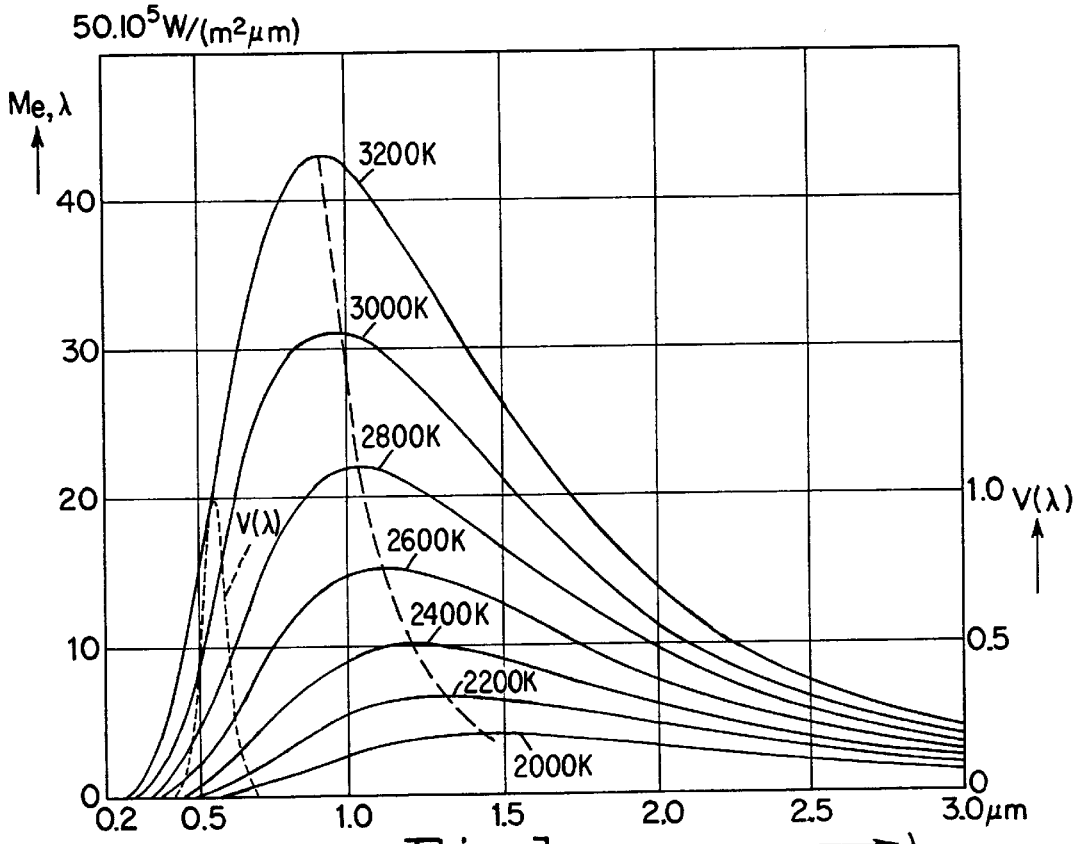
FIG. 1 is a black body spectral emission graph plotted as a function of wavelength for several different temperatures, with a graph of the eye's spectral sensitivity plotted along the same wavelength axis.

The invention operates as follows. The radiant primary 102 is heated to 2500 K by connecting typical household electricity (120 V, 60 Hz) across the connection tips 110. The resulting radiant energy is absorbed by the inner absorbing layer of the radiant secondary 202, heating it to incandescence and causing it to radiate brilliantly, half of which is reemitted back into the cylindrical radiant cavity 106 to be reabsorbed while the other half emits into the outer reflecting layer 204 which reflects roughly 90% of it back to the inner layer to be reabsorbed. In the instant after it is turned on thermodynamic equilibrium is reached within the radiant cavity where emissions from the radiant primary plus emissions and reflections from the inside surface of the radiant secondary establish cavity radiation of close to the same temperature as that of the radiant primary. In the present case, with the radiant primary at 2500 K, the cavity radiation is at 2393 K, the inner layer of the secondary is at 2336 K while the outer layer is at 2325 K (see Appendix B). The incandescent state of the outer layer is maintained by energy transmitted from the inner layer, approximately half by radiation and half by thermal conduction. And due to its almost three orders of magnitude greater a, in the visible vs. the IR (which from the solution of Eq. (2) for optically thick media with $1-z_\nu<<1$ in the visible, give emissivities which are greater in the visible than in the IR by well over an order of magnitude), the reflecting layer emits more than an order of magnitude more efficiently in the visible than in the IR And since it is optically thick, essentially none of the radiation generated by the inner layer is externally transmitted so that the radiated emissions of the reflecting layer are the radiated emissions of the entire device. The efficiency calculation in the last paragraph of Appendix B shows that the invention emits 23% of its energy at visible frequencies with an emissivity of 0.446 at $\lambda=0.55$ $\mu$m as opposed to the 8% (with approximately the same emissivity) attainable by a typical 100 watt incandescent bulb. And note that although higher temperatures mean an increased percentage of visible radiation, FIG. 1, the invention operates at a tungsten filament temperature of 2500 K and outer layer temperature of 2325 K while the typical 100 W bulb operates at filament temperatures above 2800 K. In addition since higher filament temperatures also mean increased evaporation rates, which decrease filament life, the typical 100 W bulb infill the bulb with an inert gas which collide with the evaporating tungsten molecules, sending a portion of them back to the filament and thereby giving a 2800 K filament similar lifetimes as that of a vacuum operated 2500 K filament. But since energy is lost via thermal conduction through the fill gas their overall efficiency is less than the nominal 8% (approximately 6–7%). Conversely, the invention operates within a vacuum at a much lower temperature and so avoids this gas conduction loss.

An additional design consideration in the invention is the life of the emitter which, like other incandescent sources is limited by the life of the filament wire. However, the filament temperature (and therefore the filament's emission efficiency) of a standard bulb is, given a set voltage and wattage, solely dependent on filament cross sectional area (the smaller the area the greater the current density, yielding a smaller emitting surface to radiantly dissipate the absorbed thermal energy, which results in greater retained thermal energy and a correspondingly higher temperature). But in the invention, since roughly 90% of the power emitted by the filament is reabsorbed from the radiant cavity, the temperature of the filament is primarily dependent on how much of this radiated power remains inside the cavity (i.e. the emissivity of the outer layer of the radiant secondary). As a result the filament wire can be made as thick as the required filament resistance and cavity area allow. And since filament life is directly proportional to filament radius, this additional degree of freedom allow an increase in filament life without an accompanying decrease in luminescence efficiency. As a specific example, the filament wire of a typical 100 watt bulb is about 0.66 m long and 0.07 mm thick while an equally thick filament of the invention which radiates the same visible power can be roughly 1.7 meters long, or a 0.083 mm thick filament can be 2.5 m long. While the thinner filament has nominally the same lifetime as that of the 100 W bulb, the thicker filament lasts approximately 1.2 times longer. Also note that 'n' thick filament emitters could be connected in series inside the same bulb, thereby allowing the diameter and lifetime of each filament to be increased by a factor of $n^{1/2}$ over that of a single thin filament emitter of the same total wattage.

Many embodiments of the same composite multielement design are possible.

For instance, in the present embodiment the energy radiated from the end caps 108 is minimized by constructing them from thick, undoped, high porosity zirconia, and the radiation from the sides are symmetrically distributed around the cylinder. But one or both ends could be made just like the sides, or the sides could be made minimally radiant while one end emits directionally (useful in spotlights, flashlights or car head lights). Or, the ends and one hemisphere of the side could be made minimally radiant so only one hemisphere radiates (useful in flood lights).

Also, since the cavity radiation is the same temperature throughout, regardless of shape, the radiant secondary can be other shapes besides cylindrical.

Another important alternative embodiment is to infill the radiant cavity (but not the bulb) with an inert gas to increase the filament life, or for the same life, to allow an increase in operating temperatures. To further magnify this effect, a certain percentage of halogen gas could be introduced as well. Of course such gas filled cavities require that a relatively nonporous layer of doped or undoped zirconia be included within the radiant secondary and endcaps, and that the connection tips seal airtightly to the endcaps.

Another embodiment which, though less efficient, would somewhat reduce fabrication costs, is to omit the inner layer of the radiant secondary. But since the main purpose of this layer is to provide a source of thermally conducted power for the reflecting layer, the reflecting layer must now rely solely on the radiant power it directly absorbs from the cavity. This drops its operating temperature down to around 2100 K where only 7.3% of its radiated energy is within the visible. One way of increasing the temperature is to mount the radiant secondary directly onto the radiant primary so that there is significant thermal conduction between the two. Of course this arrangement would mean constructing the secondary of other than ceria doped zirconia. One possibility is ceria doped thoria which, unlike zirconia, is an electrical insulator and is more stable in contact with tungsten and carbon at high temperatures.

Another modification involves supporting the center of the filament away from the side of the radiant secondary by attaching to it a wire loop or tungsten disk of slightly larger radius than the filament coil, similarly to what is done in cylindrical halogen bulbs to support the filament within the cylindrical bulb.

As a final example, it is possible to obtain higher radiant secondary temperatures with the same radiant primary temperature (and consequently higher efficiencies) by heating the radiant cavity with a higher emissivity radiant primary. For instance, carbon and zirconium carbide both have significantly higher emissivities than tungsten. However, tungsten may still be the best compromise between price, longevity and emissivity.

In light of so many examples of the same fundamental composite multielement design, the specificities of the descriptions should not be construed as limiting the scope of the invention. Instead, the scope of the invention should be determined by the appended claims and their legal equivalents.

APPENDIX A

The definition of the functiosn used in Eq. (3) and their related functions are as follows:

$$L_1(\mu) = l_1(\mu) + 2\mu^2 E_3\left(\frac{K_{vd}}{\mu}\right)$$

$$L_2(\mu) = 1 - \rho_{v0} l_2(\mu)$$

$$\mu_M = 1 - \left(\frac{1}{n_f}\right)^2$$

$$l_1(\mu) = \mu^2\gamma\{A_4[m_2(\mu)A_2 - m_1(\mu)A_1] - m_3(\mu)\}$$
$$l_2(\mu) = \mu^2\gamma\{A_4[m_1(\mu)A_2 - m_2(\mu)A_1] - m_0(\mu)\}$$

$$l_3(\mu) = n_f\mu^2\left\{\left[1 - 2E_3\left(\frac{K_{vd}}{\mu}\right)\right] - A_3A_4[m_1(\mu) - m_2(\mu)]\right\}$$

$$m_1(\mu) = \frac{1}{1 + \mu\sqrt{1 - \frac{z_v}{\mu}}}\left[1 - \exp\left(-r - \frac{y}{\mu}\right)\right]$$

$$m_2(\mu) = \frac{1}{1 + \mu\sqrt{1 - \frac{z_v}{\mu}}}\left[e^{-r} - e^{-\frac{y}{u}}\right]$$

$$m_3(\mu) = \frac{1}{1 - \mu}\left[e^{-y} - e^{-\frac{y}{u}}\right] \text{ for } \mu \neq 1 \qquad m_3(1) = ye^{-y}$$

$$m_0(\mu) = \frac{1}{1 + \mu}\left[1 - \exp\left(-\frac{y}{\mu} - y\right)\right]$$

$$A_1 = \frac{4w_+}{7u}e^{-y} - \frac{w_-}{4}e^{-r}$$

$$A_2 = \frac{w_+}{4} + \frac{4w_-}{7}e^{-r-y}$$

$$A_3 = w_+ - w_-e^{-r}$$

$$A_4 = \frac{z}{w_+^2 - w_-^2e^{-2r}}$$

$$E_3(u) = \int_0^1 v\exp(-u/v)\,dv$$

$$w_+ = 1 + \sqrt{1 - z_v}$$

APPENDIX A-continued

The definition of the functiosn used in Eq. (3) and their related functions are as follows:

$$w_- = 1 - \sqrt{1 - z_v}$$

$$\gamma = \frac{3z_v}{8\{1 - [z_v/(1 - u^2)]\}}$$

$$r = 2\sqrt{1 - z_v}\,K_{vd}$$

$$y = \frac{3}{2}K_{vd}$$

$$z_v = \frac{\sigma_v}{a_v + \sigma_v}$$

$$K_{vd} = (a_v + \sigma_v)d$$

APPENDIX B

First, we desire to know the temperature of the inner layer of the radiant secondary, $T_s$, given the temperature of the radiant primary, $T_p$. One way to proceed is to recognize that both temperatures can be expressed in terms of the temperature of the cavity radiation, $T_c$ according to the following two observations.

(1) From the conservation of energy, the difference between the power emitted by the radiant primary and the power absorbed by the primary from the cavity is the power externally radiated by the radiant secondary. (For the time being we will assume that the temperature difference between the inner and outer layers are small and check it later for consistency). We can approximate the tungsten filament wire as a gray body emitter with emissivity $\epsilon_p$=0.37. Therefore, since the total power density emitted by a black body is proportional to $T^4$ where the constant of proportionality is $S_0$, for a radiant secondary with outer radius $r_o$ externally radiating with power density $W_R(T_s)$, and a radiant primary with radius $r_p$, we can write, $$\epsilon_P r_P(s_0T_P^4 - s_0T_C^4) = r_oW_R(T_S), \tag{B1}$$

where we use the fact that absorbtivity equals emissivity.

(2) Likewise, the difference between the power absorbed from the cavity by the radiant secondary and the power emitted back into the cavity by the secondary is the power externally radiated. Since the inner layer of the secondary absorbs relatively uniformly across the spectrum (as can be seen by using Eq. 3 with the stated scattering coefficient and the absorption coefficients given by Eq. 4 multiplied by the volume percent), it can be approximated as a gray body with an average emissivity $\epsilon_1$=0.6. So for a secondary with inner radius $r_i$ we can write, $$\epsilon_i r_i(s_0T_C^4 - s_0T_S^4) = r_oW_R(T_S) \tag{B2}$$

$$\left[r_o\left(\frac{1}{\varepsilon_p r_p} + \frac{1}{\varepsilon_i r_i}\right)\right]^{-1} s_0(T_P^4 - T_S^4) - W_R(T_S) = 0 \tag{B3}$$

Since the emissivity of the outer layer as given by Eq. (3) varies significantly with frequency and this is used to determine $W_R$, Eq. (B3) must be solved numerically to determine $T_S$ for a given $T_P$. We do this with $T_P$=2500 K, $r_P$=1.5 mm, $r_i$=1.9 mm, and $r_o$=2.5 mm to give that $T_S$=2336 K.

We now take into consideration that since the outer layer is heated by the inner layer (via thermal conduction and radiative transfer) it must be at a lower temperature to establish an outward power flow. Maintaining our assumption of a small temperature difference, as a worst case scenario we can approximate that, since emissivity equals absorbtivity, the outer layer reemits back into the inner layer all the radiant power it absorbs from it. Therefore, all the power externally emitted by the outer layer must be supplied via thermal conduction from the inner layer. To see if this can be done across a negligibly small temperature difference, for a thermal conductivity $K_T$, we write the thermal conduction equation as, $$K_T \frac{\Delta T}{\Delta x} = W_R(T_S) \tag{B4}$$

From our numerical evaluation, we get that $W_R(T_S)$=79081 W/m$^2$, and with a thermal conductivity of 2.1 W/m-°C. (which is that of 14% porous zirconia extrapolated from 1700 K) and $\Delta x$=0.3 mm, the average layer width in Eq. (B4), we get $\Delta T$=11 K. This is indeed a negligible difference in temperature because it represents only a 4% difference in $W_R(T_S)$. Therefore we are justified in our approach and we assign the outer layer a temperature of 2325 K.

At this temperature the power density radiated within the visible is 17260 W/m$^2$, that within the IR is 58210 W/m$^2$, and that within the UV is 167 W/m$^2$, which means that 23% of the power radiated by the invention is within the visible.

What is claimed is:

1. An incandescent electromagnetic radiation source comprising:

(a) A radiant primary which generates a radiant and a thermal energy, (b) a radiant secondary which absorbs a portion of said radiant energy and a portion of said thermal energy and, within an emitting volume, incandescently generate and externally radiate an electromagnetic energy, (c) optical scattering coefficients and optical absorption coefficients within said emitting volume such that said optical scattering coefficients are much larger than said optical absorption coefficients within the visible and infrared portions of the electromagnetic spectrum.

2. The radiation source of claim 1 where said optical absorption coefficients within the visible portion of the spectrum are much larger than said optical absorption coefficients within the infrared portion of the spectrum.

3. The radiation source of claim 1 where said radiant primary is a coiled refractory metal wire which generates said radiant and thermal energies via electrical resistance heating.

4. The radiation source of claim 1 where said radiant secondary is a composite comprising refractory oxides.

5. The radiation source of claim 1 where a portion of said radiant secondary is covered by a radiation blocking means such that said electromagnetic energy which is externally radiated through said portion of said radiant secondary is minimized and there is a directional nature to said externally radiated electromagnetic energy.

6. The radiation source of claim 5 where said radiation blocking means is a refractory oxide with a scattering coefficient and an absorption coefficient such that said scattering coefficient is much larger than said absorption coefficient.

7. A method of incandescently generating electromagnetic radiation where, (a) radiant energy is injected within a radiant cavity at incandescent temperatures by energy injection means, thereby heating said cavity to incandescent temperatures and promoting cavity radiation, (b) said cavity radiation is absorbed from said radiant cavity and converted to a thermal energy by radiation absorption means, (c) within an emitting volume, said thermal energy is incandescently converted to externally radiated electromagnetic energy by radiation emitting means, (d) said radiation emitting means is a refractory material possessing optical scattering coefficients and optical absorption coefficients such that said optical scattering coefficients are much larger than said optical absorption coefficients within the visible and infrared portions of the spectrum.

* * * * *